United States Patent [19]

Savov et al.

[11] 4,200,452

[45] Apr. 29, 1980

[54] METHOD FOR THE REFINING OF IRON-BASED MELTS

[75] Inventors: Peter H. Savov; Vassil G. Peev; Alexander Y. Valchev; Nikola A. Lingorski, all of Sofia, Bulgaria

[73] Assignee: DSO "Cherna Metalurgia", Sofia, Bulgaria

[21] Appl. No.: 920,273

[22] Filed: Jun. 29, 1978

[30] Foreign Application Priority Data

Jul. 1, 1977 [BG] Bulgaria ..... 36772

[51] Int. Cl.[2] ..... C21C 5/52; C21C 7/10

[52] U.S. Cl. ..... 75/12; 75/49

[58] Field of Search ..... 75/11, 12, 49

[56] References Cited

U.S. PATENT DOCUMENTS

| | | | |
|---|---|---|---|
| 3,501,289 | 3/1970 | Finkl | 75/49 |
| 3,501,290 | 3/1970 | Finkl | 75/49 |
| 3,547,622 | 12/1970 | Hutchinson | 75/49 |
| 3,761,242 | 9/1973 | Finkl | 75/49 |

*Primary Examiner*—P. D. Rosenberg

*Attorney, Agent, or Firm*—Karl F. Ross

[57] ABSTRACT

A method of and an apparatus for the refining of a ferrous melt makes use of a ladle with a removable cover provided with a porous plug at its bottom through which an inert gas is introduced. A direct current source is connected to a carbon electrode in contact with the melt and at least one electrode above the melt.

3 Claims, 1 Drawing Figure

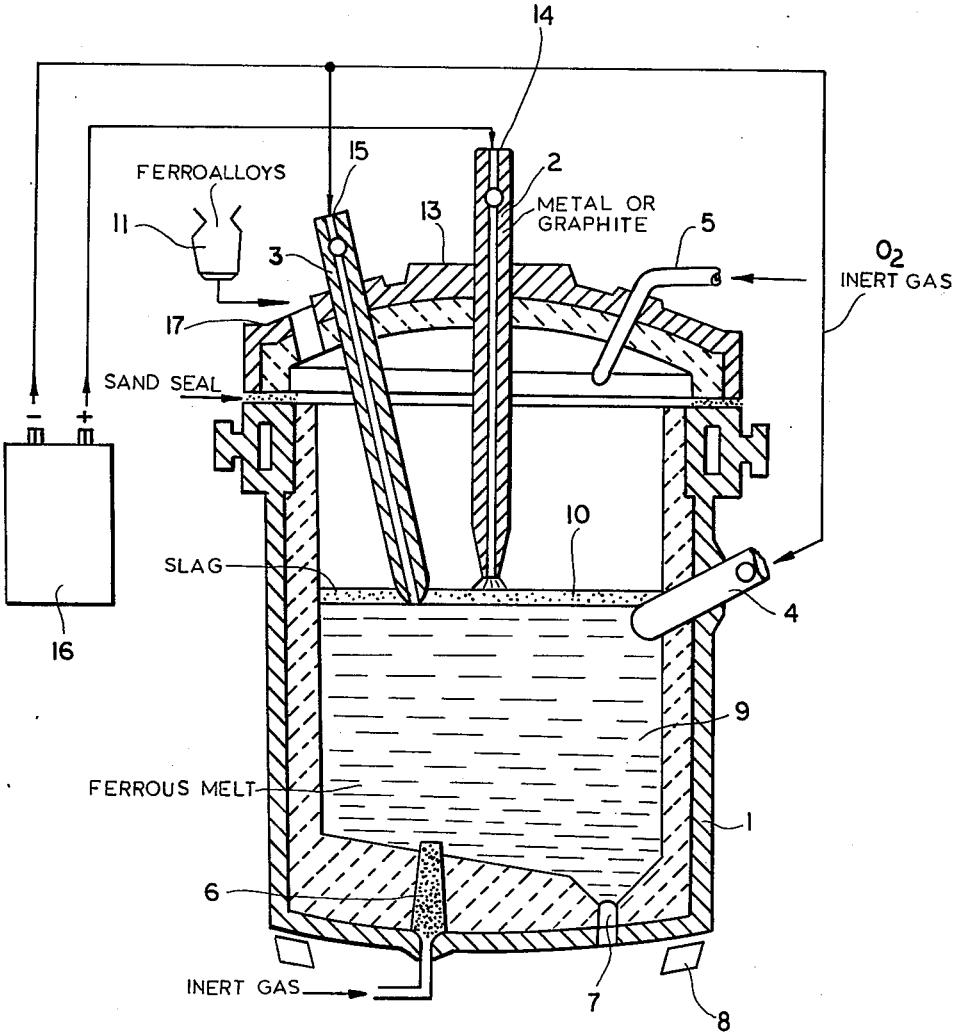
14
15
2
FERROALLOYS
METAL OR
GRAPHITE
13
5
11
3
$O_2$
INERT GAS
17
SAND SEAL
10
SLAG
4
16
9
FERROUS MELT
1
6
INERT GAS
7
8

METHOD FOR THE REFINING OF IRON-BASED MELTS

This invention relates to a method of and a device for the refining of iron-base melts using a DC heating and gas-stirring of the bath.

BACKGROUND OF THE INVENTION

There are known methods of out-of-furnace steel refining, wherein the establishment of a vacuum in the ladle is used in combination with an AC - arc heating (ASEA-SKF, Finnkle et al - processes) with simultaneous gas or electromagnetic stirring of the melt inside of the ladle. Another version of induction heating has also been developed (IT - process). The basic shortcoming of these methods is the prolonged cycle of treatment due to the separation of the degassification processes under vacuum conditions, the electric-arc heating and desulphurization, as independent steps.

Devices using vacuum-type systems together with AC-arc or other types of heating of the metal inside the ladle use two or more sequentially located stands of the vacuum and the heating system, each stand having an appropriate device for the stirring of the melt.

The simultaneous and successive uses of vacuum and AC - arc heating is linked to a complicated design of the roof or the upper part of the vacuum chamber, to rapid wear of the lining, and to high consumption of electrodes.

OBJECT OF THE INVENTION

The aim of this invention is to provide a method of and a device for the refining of iron-base melts, wherein the degassification, the deoxidation, the alloying, the homogenization as per composition and temperature, and the desulphurization are effected in a single productive cycle (cycle of production).

SUMMARY OF THE INVENTION

This object attained according to the invention by a method wherein the untreated melt is introduced into the reactor ladle, wherein the basic refining processes are effected followed by DC-heating occurs together with an electrochemical degassification and treatment of the melt; stirring with the aid of inert gas blown through one or more porous; plugs in order to minimize the partial pressure of the $O_2$, $H_2$ and $CO_2$ in the atmosphere of the reactor-ladle by the blowing-in of inert gas (Ar or $N_2$) or by dilution with an evacuating system; correction of the chemical composition by the addition of any necessary ferroalloys and deoxydizers; a treatment with synthetic slag or other mixtures in order to desulphurize the melt; an oxygen blowing via the roof or an inert gas-plus-oxygen blowing through the bottom, especially when a deep decarbonization of the melt is desired, and, finally, taking of samples with the measuring of temperature and the pouring of the melt.

THe use of a DC-arc heating, besides add heat itself ensures the occurrence of some refining electrochemical reactions such as electrochemical dehydrogenization, desulphurization, etc. A supply of nitrogen through one of the electrodes allows an intensive nitrogenization of the melt.

The device, by means of which the method is effected, comprises a reactor ladle with holes on its bottom which receive porous refractory plugs for the blowing of the melt and a hole for the pouring cup. The ladle is covered by a movable roof with a sand- or other type of seal for the furnace space. Through the fireproof roof two or more graphite electrodes are inserted, i.e. one or more anodes and a cathode. It is also possible of inserting the anodes into the metal melt through the body of the ladle.

Through the roof passes a nozzle or tube for the supply of an inert gas or of an oxidizing gas. At the opposite end of the gas-supply tube and out of the roof of the ladle a hopper for the ferroalloys supply is installed.

The device makes it possible to carry out a flexible run of a broad scale of technical operations such as deoxidation, degassification, desulphurization, the alloying, the nitrogenization, etc.

BRIEF DESCRIPTION OF THE DRAWINGS

The method is explained in greater detail by means of the drawing of which the sole FIGURE is a cross-sectional view.

SPECIFIC DESCRIPTION

After the charging of the metal-carrying ladle under the roof 13, inert gas is introduced via the tube 5 in order to obtain a neutral atmosphere in the free space, above the upper surface of metal 9 or the slag 10 and below the roof 13; alternatively any necessary dilution is effected by means of appropriate vacuum pumps.

Two or three minutes later, the electric arc is ignited which burns between the cathode 2 and the metal 9 or the slag 10. The power of the arc is automatically controlled but in such a way, as to ensure the necessary density of the current for the run of the electrochemical reactions and the necessary heat flow for the heating of the metal to the desired temperature and compensation of temperature losses coming from the blowing of the metal with argon or nitrogen, which starts together with the ignition of the electric arc. The quantity of the inert gas supplied through the porous plug 6 varies from 0.05 to 0.6 $mm^3/t$ during the blowing while the treatment time and the quantity of the blowing gas depend upon the composition of the melt and the required final concentration of gases in said melt.

During the treatment, through the hopper 11 or by entrainment in the inert gas of tube 5, desulphurizing, deoxidizing and alloying mixtures are supplied to the process. By regulating the distance between the electrodes and the bath, it is possible to change the polarity of the liquid bath to obtain a defined electrochemical reaction. Ten or fifteen minutes before the end of the metal treatment, the hopper 11 feeds ferroalloys into the melt for the corrections of the composition, the temperature is noted, and after the specification of the correcting composition the metal treating operation may be regarded as completed.

For the production of stainless steel, highly alloyed with chrome, it is possible blow an oxygen-argonic mixture through the porous plug 6or with an oxygen stream via a lance instead of inert gas via the tube 5, i.e. in parallel with the blowing-in of inert gas through the bottom of the ladle.

The necessary heat flow is controlled as to power and time by highly-precise automation means, according to controlling programs pre-set for each melt, with the introduction of dynamic corrections after the detection of temperature and taking samples to analyze the process.

When the metal of the melt is to be alloyed with nitrogen or some other fluid, through the holes 14 or 15 of cathode 2, or the anodes 3, the necessary quantity of alloying fluid is supplied. The device comprises the ladle 1 for the treatment and casting of the metal, the bottom of said ladle comprising - besides the metal-pouring hole 7, also the porous plug 6 to allow blowing with inert gas. The water-cooled anode 4 is laterally (angularly or radially) located, said anode being used for the introduction of the positive pole into the metal melt. The reactor ladle is covered by the refractory roof 13, sealed to said ladle by means of a sand-seal, ensuring the necessary sealing of and for the operating space/or room. Along the axis of the roof a hole is provided, through which passes the graphite or metal cathode 2. Laterally of this cathode, that is angularly or in parallel, one or more holes receiving the metal or graphite anodes 3 are provided. At a distance, less than ½ of the radius, there is a hole for the supply of inert gas, or a flange-type fitting for connection to the vacuum system. At one end of the roof the hole 17 is provided for the supplyof ferroalloys from the hopper 11. In operation the positive pole of the current is introduced through the anodes 3 or 4. When necessary to alloy the melt melt with gs, the gases are fed through the passages 14 or 15 of the cathode 2 and the anode 3, electrically supplied by the DC-source 16.

We claim:

1. A method of refining a ferrous melt, comprising the steps of:

(a) introducing the ferrous melt into a ladle;

(b) applying and sealing a cover to said ladle;

(c) introducing a stirring gas into the melt in said ladle through a porous plug in the base of said ladle;

(d) heating the melt in said ladle by passing a direct electric current through said melt between two electrodes in contact therewith and by additionally generating an arc with direct current between another electrode spaced from above the melt; and (e) introducing a gas into said melt through at least one of said electrodes.

2. The method defined in claim 1, further comprising the step of evacuating the ladle above said melt through an opening in said cover.

3. The method defined in claim 1, further comprising the step of introducing oxygen into said melt through said cover.

* * * * *